US008708067B2

(12) United States Patent
Prokopchuk

(10) Patent No.: US 8,708,067 B2
(45) Date of Patent: Apr. 29, 2014

(54) DRILL PIPE

(75) Inventor: Norman Prokopchuk, Edmonton (CA)

(73) Assignee: Advanced Coring & Drilling Solutions Inc., Edmonton (CA)

( * ) Notice: Subject to any disclaimer, the term of this patent is extended or adjusted under 35 U.S.C. 154(b) by 187 days.

(21) Appl. No.: 12/878,340

(22) Filed: Sep. 9, 2010

(65) Prior Publication Data

US 2011/0083841 A1 Apr. 14, 2011

(30) Foreign Application Priority Data

Oct. 14, 2009 (CA) ..... 2682630

(51) Int. Cl.
*E21B 17/00* (2006.01)

(52) U.S. Cl.
USPC ..... 175/325.2; 175/57; 166/242.6; 285/333

(58) Field of Classification Search
USPC ..... 166/170, 173, 241.6, 242.6; 175/325.1–325.5, 57; 285/333
See application file for complete search history.

(56) References Cited

U.S. PATENT DOCUMENTS

| | | | | |
|---|---|---|---|---|
| 2,838,121 | A * | 6/1958 | Coyle | 166/173 |
| 3,268,274 | A | 8/1966 | Ortloff et al. | |
| 3,447,839 | A | 6/1969 | Salvatori | |
| 3,747,700 | A | 7/1973 | Rilling | |
| 3,916,998 | A | 11/1975 | Bass, Jr. et al. | |
| 3,938,853 | A | 2/1976 | Jurgens et al. | |
| 4,156,374 | A | 5/1979 | Shwayder | |
| 4,275,935 | A | 6/1981 | Thompson et al. | |
| 4,436,158 | A | 3/1984 | Carstensen | |
| 4,438,822 | A | 3/1984 | Russell | |
| 4,526,241 | A | 7/1985 | Anders | |
| 4,610,316 | A | 9/1986 | Boaz | |
| 4,664,206 | A | 5/1987 | Butler | |
| 5,181,576 | A | 1/1993 | Askew et al. | |
| 6,032,748 | A | 3/2000 | DeBray et al. | |
| 6,464,013 | B2 | 10/2002 | Bystedt | |
| 6,736,224 | B2 * | 5/2004 | Kinsella | 175/58 |

FOREIGN PATENT DOCUMENTS

GB 2424234 9/2006

OTHER PUBLICATIONS

Grant Prideco. "Spiral-Wate Drill Pipe". Available at http://www.grantprideco.com/drilling/products/heavyweight/spiralWate.asp. Accessed May 28, 2009. Available at least as early as 2008.
Oil and Gas Blog. "Type of tubing connection." Available at http://oil-n-gas.blogspot.com/. Accessed May 28, 2009. Available at least as early as May 28, 2009.

* cited by examiner

*Primary Examiner* — Yong-Suk (Philip) Ro
(74) *Attorney, Agent, or Firm* — Davis & Bujold, PLLC; Michael J. Bujold

(57) ABSTRACT

A drill pipe assembly includes an elongate drill pipe and a drill pipe extension. The elongate drill pipe has a first threaded end and a second threaded end. The drill pipe extension has a first threaded end and a second threaded end. The second threaded end matingly engaging the first threaded end of the elongate drill pipe. The first threaded end being adapted to matingly engage an additional component of a drill string. The drill pipe extension has an external upset. The external upset has recessed flow paths.

18 Claims, 3 Drawing Sheets

DRILL PIPE

FIELD

Drill pipes for wellbores

BACKGROUND

Drill pipe is used to drill underground wells, and is supplied by, for example, Grant Prideco Inc. (www.grantprideco.com).

SUMMARY

There is provided a drill pipe assembly, comprising an elongate drill pipe and a drill pipe extension. The elongate drill pipe has a first threaded end and a second threaded end. The drill pipe extension has a first threaded end and a second threaded end, the second threaded end matingly engaging the first threaded end of the elongate drill pipe, the first threaded end being adapted to matingly engage an additional component of a drill string. The drill pipe extension has an external upset toward the first threaded end, the external upset having recessed flow paths.

According to another aspect, the elongate drill pipe may have an upset at each of the first and second threaded ends. The length of the external upset may be less than one third the length of the drill pipe extension. There may be an additional drill pipe extension having a first threaded end and a second threaded end, the first threaded end engaging the second threaded end of the elongate drill pipe. The additional drill pipe extension may have a constant outer diameter. The recessed flow paths may comprise at least 65% of the circumference of the external upset. The drill pipe may have an outer diameter of between 5 and 5¼ inches, and the external upset may have an outer diameter of between 5⅞ and 6¾ inches.

According to another aspect, there is provide a method of drilling a well, comprising the steps of: providing a first elongate drill pipe comprising a first threaded end and a second threaded end; threading a second end of a drill pipe extension onto the first threaded end of the elongate drill pipe, the drill pipe extension having an external upset, the external upset having recessed flow paths; and installing the elongate drill pipe and drill pipe extension in a wellbore, the inner diameter of the wellbore being not more than ¾ inches greater than the outer diameter of the external upset, the recessed flow paths providing relief against hydrojacking.

According to another aspect, the elongate drill pipe may have an upset at each of the first and second threaded ends. The length of the external upset may be less than one third the length of the drill pipe extension. There may be an additional drill pipe extension having a first threaded end and a second threaded end, the first threaded end engaging the second threaded end of the elongate drill pipe. The additional drill pipe extension may have a constant outer diameter. The recessed flow paths may comprise at least 65% of the circumference of the external upset. The diameter of the drill pipe may be between 5 inches and 5¼ inches, and the outer diameter of the external upset may be between 5⅞ and 6¾ inches. The drill pipe may be installed in a wellbore having an inner diameter that is no more than ½ inch greater than the external upset. The wellbore may comprises casing, the inner diameter of the wellbore being not more than 1¼ inches greater than the outer diameter of the drill pipe.

According to another aspect, there may be provided a drill pipe, comprising a pipe body having a first threaded end and a second threaded end for connecting the pipe body in a drill string. The pipe body may have an external upset toward the first threaded end, the external upset having recessed flow paths.

According to another aspect, the recessed flow paths may comprise at least 65% of the circumference of the external upset. The pipe body may have an outer diameter of between 5 and 5¼ inches, and the external upset may have an outer diameter of between 5⅞ and 6¾ inches. The pipe body may have an upset at each of the first and second threaded ends.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
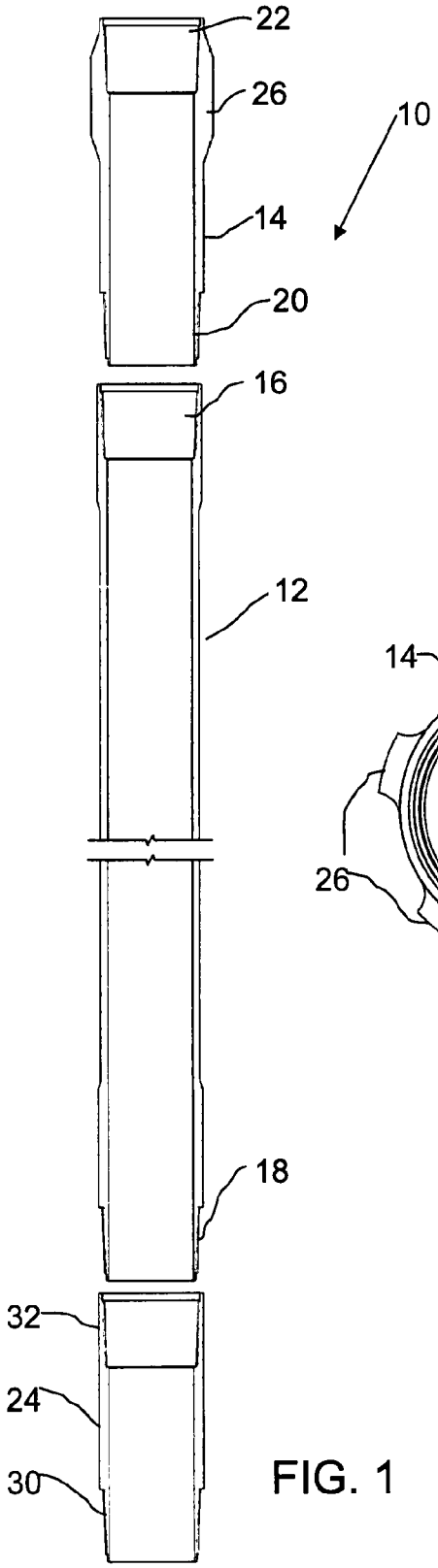
FIG. 1 is an exploded side elevation view in section of a drill pipe assembly.
Figure 2:
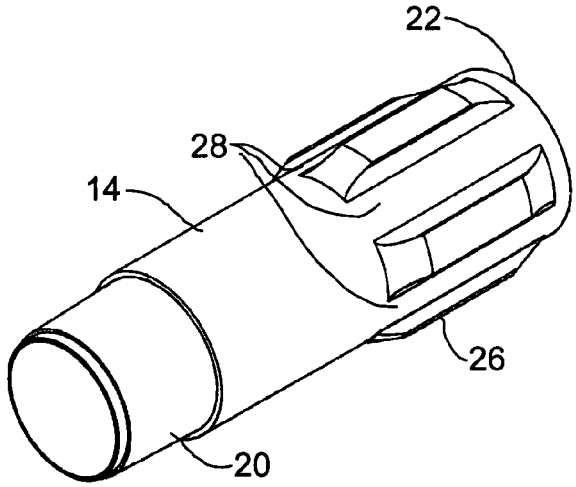
FIG. 2 is a perspective view of a drill pipe extension with external upset.

A drill pipe assembly generally identified by reference numeral 10, will now be described with reference to FIG. 1 through 6.

Structure and Relationship of Parts:

Referring to FIG. 1, drill pipe assembly 10 has an elongate drill pipe 12 and at drill pipe extension 14. Drill pipe 12 has a first threaded end 16, a second threaded end 18, and a constant outer diameter. Drill pipe extension 14 has a first threaded end 20 and a second threaded end 22. Second threaded end 22 is designed to matingly engage first threaded end 16 of elongate drill pipe 12. First threaded end 20 is adapted to engage another components of the drill string, such as an additional elongate drill pipe, or, as depicted, an additional drill pipe extension 24. Additional drill pipe extension 24 has a first threaded end 30 and a second threaded end 32. First threaded ends and second threaded ends of each of drill pipe 12, drill pipe extension 14 and additional drill pipe extension 24 are the same as other first and second threaded ends, respectively, so that they can be connected to form an assembly 10 of the desired length. As shown, additional drill pipe extension 24 has a constant outer diameter.

Drill pipe extension 14 has an external upset 26 between first threaded end 20 and second threaded end 22. Preferably, external upset 26 is in the middle, but may be at any convenient location along its length. External upset 26 has recessed flow paths 28 that prevent or reduce the effect of hydraulic jacking. Recessed flow paths 28 may be formed by machining upset 26, or formed during the manufacturing process of drill pipe extension 14. Preferably, recessed flow paths 28 cover at least 65% of the circumference of external upset 26. Recessed flow paths 28 must leave a sufficient amount of material for external upset 26 to support a load. As depicted, the length of external upset 26 covers less than one third the length of drill pipe extension 14. The diameter of external upset 26 is preferably about two inches or less larger than the diameter of drill pipe extension 14. In a preferred example, drill pipe with an outer diameter of between 5 and 5¼ inches may be used in a wellbore that may or may not have casing with an inner diameter of 5⅞ to 6¾ inches. In each situation, external upset 26 will be close to, but smaller than the inner diameter of the casing, by about ¼ or ½ inches, such as between 5½ to 6¾ inches. In a preferred embodiment, external upset 26 has a diameter of 5⅞. Drill pipe 12 is preferably large enough to have an inner diameter that allows 4 inch tools to be run through. Preferably, extensions 14 and 24 are no more than 3 feet long, and preferably about 2 feet. Extensions 14 and 24 also act as saver subs, in that they may be removed and replaced if damage occurs to the threads. This avoids the need to replace an entire section of drill pipe or transport the drill pipe to a shop to be machined. Instead, extensions 14 and 24 can be transported and worked on more easily.

Figure 5:
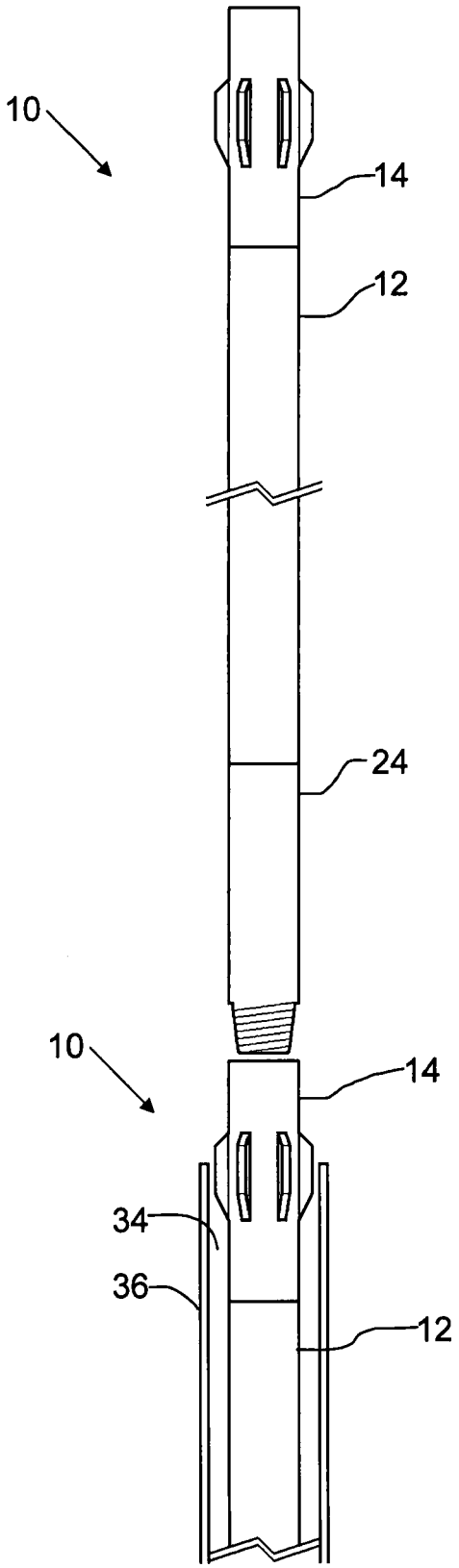
FIG. 5 is a side elevation view of a drill pipe assembly being installed.

Operation:

Referring to FIG. 5, drill pipe assembly 10 is particularly useful when large diameter drill pipes are desired in boreholes 34, which may have casing 36, that are relatively close to the outer diameter of the drill pipe 12. For example, drill pipe 12 may have an outer diameter of 5 inches, while the inner diameter of wellbore 34 or casing 36 (if present) is between 6 and 6¾ inches. In situations like that, the external upset that is normally on traditional drill pipe 12 would likely result in hydrojacking downhole, where liquids are not able to flow past the upsets as the drill string is lowered or raised. As assembly 10 is lowered into the wellbore, additional sections are added on. Preferably, drill pipe extensions 14 and 24 are attached to drill pipe 12 on the surface, and then attached to the drill string as a single unit. As the outer diameter of upset 26 is close to the inner diameter of wellbore 34, upset 26 with flow paths 28 may also act as centralizers or stabilizers.

Drill pipe assembly 10 is assembled by attaching drill pipe extensions 14 and drill pipes 12, generally one extension 14 for each drill pipe 12. There may also be included additional drill pipe extensions 24, such that drill pipe extensions 14 are attached to first end 16 of drill pipe 12 and additional drill pipe extensions 24 are attached to second end 18 of drill pipe 12. Drill pipe extensions 14 and 24 are used to protect the threads of drill pipe 12 from multiple make-ups and breakdowns. Instead of multiple threadings on drill pipe 12, extensions 14 and 24 are threaded on once at the beginning, and are then used to make-up and break-down the tool. As the threads wear out, drill pipe 12 remains on site while the affected extension 14 or 24 is taken to the shop to have it rethreaded. The advantage to this is that extensions 14 or 24 can be taken in a work truck, rather than requiring a tractor trailer to haul them. This saves the expense of a larger truck and possibly an extra trip.

In one embodiment, drill pipe assembly 10 is made from a drill pipe 12 that is about 30 feet long with a 5 inch O.D.—1,950 ft-lbs and 5 inch at 25.60 lbs/ft with extensions 14 and 24 on top and bottom of drill pipe 12 that are 2 feet long each. The threaded connections would be rated up to about 12,500 ft-lb. and use a makeup torque of 8,500 ft-lbs. The external upset on extension 14 also doubles as an elevator shoulder with an 18 degree elevator taper. Drill pipe 12 may be made by cutting off any external upsets from existing drill pipe and then rethreaded.

Figure 4:
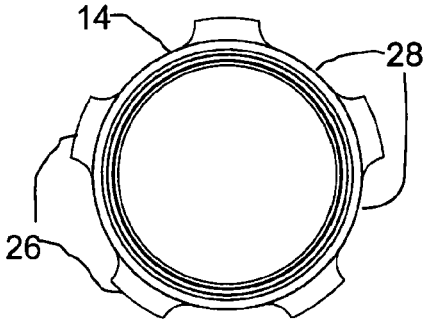
FIG. 4 is a top plan view of a drill pipe extension with external upset.
Figure 3:
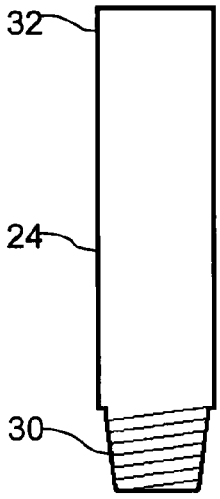
FIG. 3 is a side elevation view of a drill pipe extension without an external upset.
Figure 6:
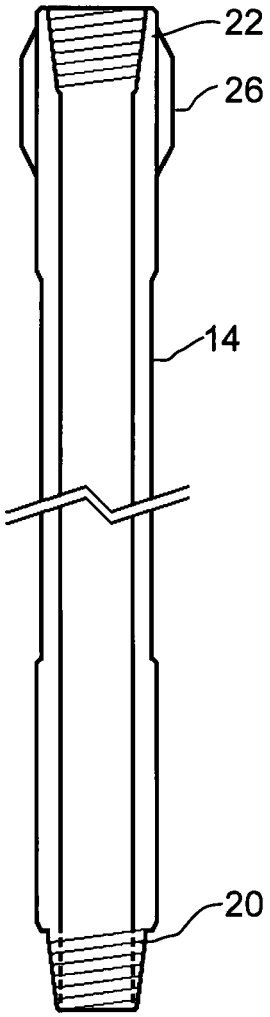
FIG. 6 is a side elevation view in section of an alternative drill pipe extension with external upset.

Referring to FIG. 6, a variation of drill pipe extension 14 is shown. As depicted, first threaded end 20 and second threaded end 22 have a slightly larger diameter than the remainder of extension 14. This is to provide additional strength to threaded connections, and also to allow extensions 14 to be rethreaded as needed. First threaded end 20 has external upsets 26 with a radial pattern similar to what is shown in FIG. 4. While external upset 26 is smaller, it is intended to perform the same tasks as discussed above. Drill pipe extension 14 may have different lengths, and may be sufficiently long to be used as drill pipe. In this situation, it may be desirable to have an upset 26 at both first threaded end 20 and second threaded end 22, although only an upset at first threaded end 20 is shown.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. A drill pipe assembly, comprising:

an elongate drill pipe having a first threaded end and a second threaded end;

a drill pipe extension comprising a circumferential recessed area between a first threaded end and a second threaded end, the second threaded end matingly engaging the first threaded end of the elongate drill pipe, the first threaded end of the extension being adapted to matingly engage an additional component of the drill pipe assembly;

the drill pipe extension having an external upset integrally formed with the drill pipe extension, the external upset having recessed flow paths, wherein the drill pipe has an outer diameter of between 5 and 5¼ inches, and the external upset has an outer diameter of between 5⅞ and 6¾ inches, wherein the circumferential recessed area having a smaller diameter than the outer diameter of the drill pipe.

2. The drill pipe assembly of claim 1, wherein the length of the external upset is less than one third the length of the drill pipe extension.

3. The drill pipe assembly of claim 1, further comprising an additional drill pipe extension having a first threaded end and a second threaded end, the first threaded end engaging the second threaded end of the elongate drill pipe.

4. The drill pipe assembly of claim 3, wherein the additional drill pipe extension has a constant outer diameter.

5. The drill pipe assembly of claim 1, wherein the recessed flow paths comprise at least 65% of the circumference of the external upset.

6. The drill pipe assembly of claim 1, wherein the recessed flow paths of the external upset are aligned with an axis of the drill pipe.

7. A method of drilling a well, comprising:

providing a drill pipe assembly having an outer diameter of between 5 and 5¼ inches, the drill pipe assembly comprising elongate drill pipes connected to a plurality of drill pipe extensions, wherein the drill pipe extensions comprising a circumferential recessed area between a first threaded end and a second threaded end, the circumferential recessed area having a smaller diameter than the outer diameter of the drill pipe assembly, the plurality of drill pipe extensions having an external upset integrally formed with the drill pipe extension and the external upset having recessed flow paths; and drilling a wellbore by inserting the drill pipe assembly into the wellbore, at least a portion of the wellbore having an inner diameter between 5⅞ and 6¾ inches, the external upsets having an outer diameter that is less than the inner diameter of the wellbore, the recessed flow paths providing relief against hydrojacking.

8. The method of claim 7, wherein the length of the external upset is less than one third the length of the drill pipe extension.

9. The method of claim 7, wherein the recessed flow paths comprise at least 65% of the circumference of the external upset.

10. The method of claim 7, wherein the external upsets of the drill pipe extensions have an outer diameter that is smaller than the inner diameter of the at least a portion of the wellbore by ¾ inch or less.

11. The method of claim 7, wherein the wellbore comprises casing.

12. The method of claim 7, wherein the recessed flow paths of the external upset are aligned with an axis of the drill pipe.

13. A method of drilling a well, comprising:

providing a drill pipe assembly having an outer diameter of between 5 and 5¼ inches, the drill pipe assembly comprising elongate drill pipes having external upsets, each external upset having recessed flow paths, wherein at least one of the elongated the drill pipes comprising a circumferential recessed area between a first threaded end and a second threaded end, the circumferential recessed area having a smaller diameter than the outer diameter of the drill pipe assembly; and drilling a wellbore by inserting the drill pipe assembly into the wellbore, at least a portion of the wellbore having an inner diameter between 5⅞ and 6¾ inches, the external upsets having an outer diameter that is less than the inner diameter of the wellbore such that the recessed flow paths provide relief against hydrojacking.

14. The method of claim 13, wherein the recessed flow paths comprise at least 65% of the circumference of the external upset.

15. The method of claim 13, wherein the external upsets of the drill pipes have an outer diameter that is smaller than the inner diameter of the at least a portion of the wellbore by ¾ inch or less.

16. The method of claim 13, wherein the external upsets of the drill pipes have an outer diameter that is smaller than the inner diameter of the at least a portion of the wellbore by ½ inch or less.

17. The method of claim 13, wherein the wellbore comprises casing.

18. The method of claim 13, wherein the recessed flow paths of the external upset are aligned with an axis of the drill pipe.

* * * * *